United States Patent [19]

Schulze

[11] Patent Number: 4,541,241

[45] Date of Patent: Sep. 17, 1985

[54] HYDRAULIC DRIVING ARRANGEMENT FOR RECIPROCABLE MASSES OR THE LIKE

[75] Inventor: Eckehart Schulze, Weissach-Flacht, Fed. Rep. of Germany

[73] Assignee: Hartmann & Lämmle GmbH & Co. KG, Rutesheim, Fed. Rep. of Germany

[21] Appl. No.: 467,285

[22] Filed: Feb. 17, 1983

[30] Foreign Application Priority Data

Feb. 20, 1982 [DE] Fed. Rep. of Germany ..... 3206162

[51] Int. Cl.[4] ..... F15B 1/04; F15B 13/04; F15B 21/02

[52] U.S. Cl. ..... 60/414; 60/413; 60/416; 91/5; 91/441

[58] Field of Search ..... 91/5, 16, 441; 60/414, 60/416, 417, 371, 375, 413; 180/165; 137/255, 266

[56] References Cited

U.S. PATENT DOCUMENTS

| | | | |
|---|---|---|---|
| 2,491,402 | 12/1949 | Tucker | 91/279 X |
| 2,977,763 | 4/1961 | Mercier | 60/416 |
| 3,171,331 | 3/1965 | Samuel | 91/448 X |
| 3,470,792 | 10/1969 | Darling | 91/441 X |
| 3,635,020 | 1/1972 | Mahlmann | 91/6 X |
| 3,797,364 | 3/1974 | Schulze | 91/380 X |
| 3,922,854 | 12/1975 | Coeurderoy | 60/413 |
| 4,098,083 | 7/1978 | Carman | 60/414 |
| 4,369,693 | 1/1983 | Schulze | 91/380 X |
| 4,370,857 | 2/1983 | Miller | 180/165 X |

FOREIGN PATENT DOCUMENTS

| | | |
|---|---|---|
| 1225012 | 9/1966 | Fed. Rep. of Germany . |
| 2501760 | 7/1976 | Fed. Rep. of Germany . |
| 3044675 | 7/1982 | Fed. Rep. of Germany . |

*Primary Examiner*—Irwin C. Cohen
*Attorney, Agent, or Firm*—Peter K. Kontler

[57] ABSTRACT

An energy-saving hydraulic driving arrangement includes a motor having two chambers separated by a reciprocable or angularly movable output element which can accelerate or decelerate a mass. One of the chambers receives pressurized fluid from one of a battery of accumulators containing fluid at different pressures (namely, from the accumulator wherein the pressure is slightly higher than the desired pressure in the one chamber) during acceleration of the output element while the other chamber discharges fluid directly into a sump. During deceleration of the output element, the one chamber draws fluid directly from the sump whereas the other chamber discharges pressurized fluid into that accumulator wherein the pressure is slightly less than the pressure of fluid in the other chamber.

9 Claims, 5 Drawing Figures

HYDRAULIC DRIVING ARRANGEMENT FOR RECIPROCABLE MASSES OR THE LIKE

BACKGROUND OF THE INVENTION

The present invention relates to fluid-operated driving arrangements, and more particularly to improvements in driving arrangements of the type wherein a mass is movable (e.g., reciprocable) by a hydraulic motor whose working chamber or chambers can receive pressurized hydraulic fluid by way of a regulating valve and the fluid is or can be expelled from the working chamber or chambers in response to movement of the motor.

German Offenlegungsschrift No. 30 44 675 discloses a driving arrangement of the above outlined character. This publication further discloses the possibility of controlling the distance which is covered by and/or the velocity of the mass by an electronic control system through the medium of the regulating valve. Still further, the aforementioned publication discloses that, for the purpose of braking or decelerating the mass, the fluid which is expelled from the hydraulic motor can be admitted, at least temporarily, into an accumulator which serves to supply at least a certain percentage of pressurized hydraulic fluid that is needed for operation of the hydraulic motor. A drawback of the driving arrangement which is disclosed in the Offenlegungsschrift No. 30 44 675 is that it does not allow for an optimum recovery of energy which is released during deceleration of the mass.

German Auslegeschrift No. 12 25 012 discloses an accumulator which is designed to reduce the shocks that develop as a result of deceleration of a moving mass. This publication also fails to make any satisfactory proposals regarding the possibility or advisability of recovering maximum amounts of energy during deceleration of a mass which is reciprocable or otherwise movable by a hydraulic motor.

OBJECTS AND SUMMARY OF THE INVENTION

An object of the invention is to provide a driving arrangement for reciprocable or otherwise movable masses which is constructed and assembled in such a way that it allows for an optimum recovery of energy during deceleration of the mass by one or more hydraulic motors.

Another object of the invention is to provide a driving arrangement which renders it possible to accelerate the mass with minimal expenditures in energy.

A further object of the invention is to provide a driving arrangement of the above outlined character which can utilize one or more conventional hydraulic motors.

An additional object of the invention is to provide a driving arrangement which can be employed as a superior substitute for heretofore known driving arrangements wherein a mass must be accelerated and/or decelerated, either at a given frequency or at randomly spaced intervals, under controlled circumstances and with minimal expenditures in as well as maximum savings or recovery of energy.

A further object of the invention is to provide a novel and improved method of recovering maximum amounts of energy during deceleration of an intermittently movable mass.

The invention resides in the provision of a driving arrangement for effecting controlled acceleration and/or deceleration of masses. The arrangement comprises a hydraulic motor having an output element (e.g., a rotary shaft with a radial piston or a reciprocable piston serving to transmit motion to a piston rod) which is capable of being accelerated and decelerated and is arranged to transmit motion to a mass (e.g., to reciprocate the mass between two end positions). The motor defines at least one variable-volume working chamber whose volume varies in response to admission of pressurized fluid or in response to expulsion of fluid by the output element. The driving arrangement further comprises a plurality of accumulators each of which serves to confine a supply of hydraulic fluid at a different pressure, and means for sealing a selected accumulator from and for connecting a selected accumulator with the working chamber so as to admit fluid from the selected accumulator into the working chamber and thereby increase the volume of the working chamber with attendant movement of the output element in a given direction during acceleration of the output element. Still further, the driving arrangement comprises a fluid-containing receptacle which can constitute or form part of the sump, and means for directly coupling the working chamber with the receptacle when the volume of the chamber is on the increase while the chamber is sealed from the accumulators so that the chamber can draw fluid from the receptacle. The aforementioned sealing and connecting means can comprise a main regulating valve which is interposed between the accumulators and the working chamber, a relay valve which is interposed between the main regulating valve and the accumulators, at least one auxiliary or additional regulating valve for each accumulator, preferably short large-diameter conduits connecting the accumulators with the working chamber and containing the auxiliary regulating valves, check valves which permit fluid to flow from the working chamber into the accumulators, and control means which can actuate the main and auxiliary regulating valves as well as the relay valve.

The coupling means preferably comprises one or more check valves which serve to permit the flow of fluid from the receptacle to the working chamber when the pressure in the working chamber is less than the pressure in the receptacle (during deceleration of the output element) but to seal the working chamber from the receptacle when the pressure of fluid in the working chamber exceeds the pressure of fluid in the receptacle. The fluid in the receptacle can be maintained at atmospheric pressure.

The output element is movable in the given direction in response to admission of pressurized fluid from a selected accumulator into the working chamber and in a different direction to expel fluid from the working chamber. The control means actuates the auxiliary regulating valve for a selected accumulator during expulsion of pressurized fluid from the working chamber so that the pressurized fluid which leaves the working chamber can enter the selected accumulator with attendant savings in energy. The pressure of fluid in the various accumulators is preferably selected in such a way that the pressure in at least one of the accumulators at most equals the pressure of pressurized fluid which is being expelled from the working chamber, and the control means of the sealing and connecting means is preferably designed to establish communication between such one accumulator and the working chamber during expulsion of pressurized fluid from the working chamber by the output element. The control means can be designed to determine the rate of fluid flow between the working chamber and the selected accumulator as a function of the distance which is to be covered by the output element and/or as a function of time.

If the motor defines two working chambers, one of the working chambers receives pressurized fluid from a selected accumulator while the other chamber discharges fluid into the sump during acceleration of the output element. The one chamber receives fluid from the sump (i.e., from the aforementioned receptacle) and the other chamber discharges fluid into a selected accumulator during deceleration of the output element. The aforementioned sealing and connecting means and the aforementioned coupling means may each comprise relatively short large-diameter conduit means connecting the sump and the accumulators with the working chambers, and one-way valve means in such conduit means. The one-way valve means includes first check valve means arranged to admit pressurized fluid from the working chambers into selected accumulators and second check valve means arranged to admit fluid from the sump into the chambers.

The sealing and connecting means can comprise discrete check valves for the accumulators, and each such check valve can be designed to be responsive to a different pressure so that it admits pressurized fluid from a working chamber to the respective accumulator when the pressure of fluid which is being expelled from the chamber is in a predetermined relationship to the pressure at which the respective check valve opens in order to admit fluid into the associated accumulator (for example, the check valve can open in response to a pressure which is only slightly higher than the pressure in the associated accumulator). This obviates the need for complex control means, e.g., such check valves can replace an electronic control circuit.

The main regulating valve of the sealing and connecting means can be mechanically coupled to the output element of the motor.

The driving arrangement further comprises a source of pressurized fluid and a pressure line connecting the source with the accumulators and the main regulating valve. The relay valve is capable of being actuated by the control means to control the flow of fluid from the source to the main regulating valve. Still further, the driving arrangement can comprise a circulating valve or analogous means for reducing the pressure of fluid in the source as a function of fluid pressure changes in the pressure line and/or as a function of pressure changes in at least one of the accumulators. This also contributes to savings in energy, for example, when the operation of the motor is interrupted and the source includes a motor for a pump which continues to circulate the fluid.

The driving arrangement can also comprise changeover valve means which can connect the source directly with a working chamber of the motor under the action of the control means and/or changeover valve means which can connect a selected accumulator directly with a working chamber, again under the action of the control means. The aforementioned auxiliary regulating valve means or additional valve means can be designed to connect the accumulators directly with the source so that the accumulators can be recharged, e.g., in order to compensate for leakage of pressure fluid.

In accordance with a modification, the control means can be provided on, or can otherwise receive motion from, a transmission which is interposed between the output element and the mass.

The novel features which are considered as characteristic of the invention are set forth in particular in the appended claims. The improved driving arrangement itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
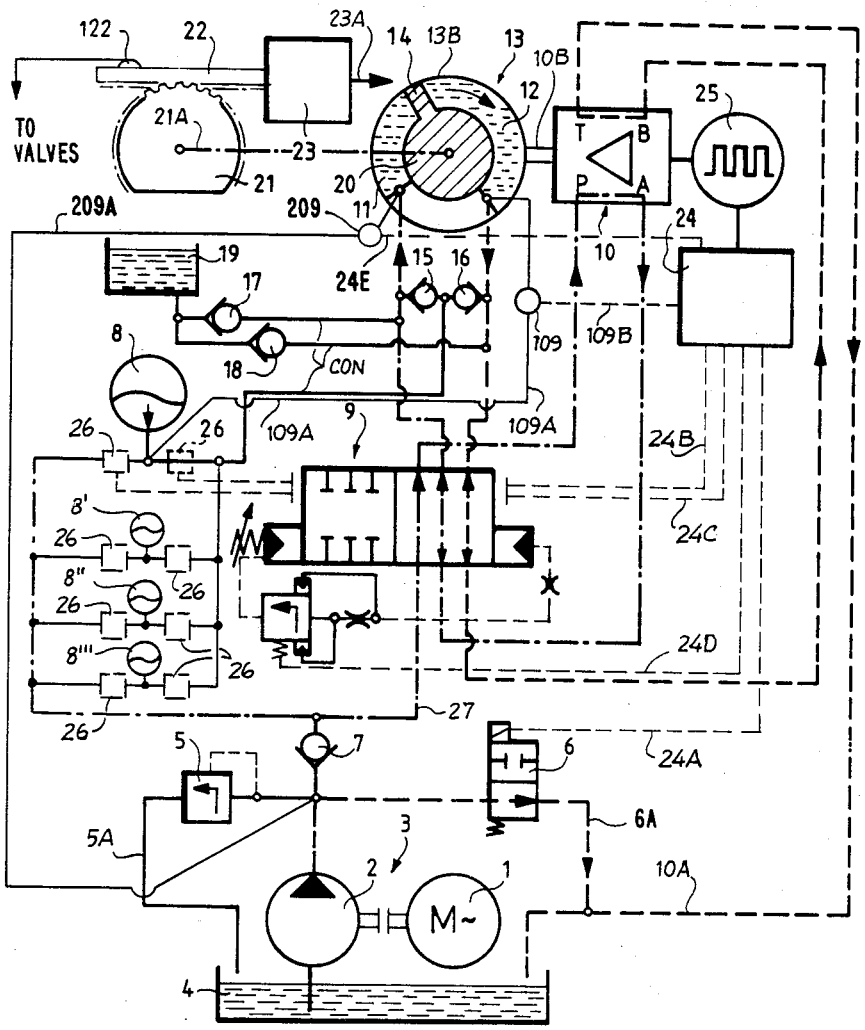
FIG. 1 is a schematic representation of a driving arrangement which embodies one form of the invention and wherein a mass is reciprocable by a hydraulic motor employing a rotary piston, the motor being in the process of accelerating the mass.

Referring first to FIG. 1, there is shown a driving arrangement which embodies one form of the invention and wherein a mass 23 is reciprocable in and counter to the direction indicated by arrow 23A by a hydraulic motor 13 through the medium of a transmission including a rack 22 connected to the mass 23, a pinion 21 meshing with the rack 22, and an operative connection (e.g., a shaft) 21A which connects the output shaft 20 of the motor 13 with the pinion 21. The motor 13 is a reversible rotary piston motor wherein a piston 14 extends radially of the shaft 20 and divides the internal space of the housing 13B of the motor 13 into a pair of arcuate working chambers 11 and 12.

The means 3 for supplying (i.e., a source of) pressurized hydraulic fluid to the motor 13 comprises a pump 2 which is driven by a motor 1 and can draw hydraulic fluid (e.g., oil) from a vessel 4 forming part of the sump. The maximum pressure of hydraulic fluid leaving the outlet of the pump 2 is determined by a relief valve 5 which opens when the pressure reaches a certain maximum permissible limit and allows the pressurized fluid to flow back into the vessel 4 via conduit 5A. A circulating valve 6 is provided in a second conduit 6A which connects the outlet of the pump 2 with the vessel 4; the purpose of the valve 6 is to open and to allow the pump 2 to circulate the hydraulic fluid at a low or very low pressure along the endless path including the vessel 4 and conduit 6A during relatively short interruptions of operation of the driving arrangement, i.e., during relatively short interruptions of reciprocatory movement of the mass 23 under the action of the hydraulic motor 13 and transmission including the parts 21, 21A and 22.

This entails substantial savings in energy when the requirements regarding the availability of pressurized hydraulic fluid are reduced to a minimum. The opening or closing of circulating valve 6 is effected by an electronic control unit 24 via conductor means 24A and/or as a function of fluid pressure in a conduit 27 for pressurized hydraulic fluid.

The source 3 of pressurized hydraulic fluid is connectable with several (e.g., four) accumulators 8, 8', 8'', 8''' via one-way ball check valve 7 and conduit 27, as well as with a relay valve 9 which latter can (directly or indirectly) admit pressurized fluid to the working chamber 11 or 12 of the motor 13. The relay valve 9 can further supply pressurized hydraulic fluid (from the source 3 or from one of the accumulators 8-8''') to the inlet port P of a main or primary regulating valve 10 which is controlled by the electronic control circuit 24 via stepping motor 25. The regulating valve 10 has additional ports A and B each of which can be caused to communicate with or to be sealed from the working chambers 11, 12 of the hydraulic motor 13. An outlet port T of the regulating valve 10 can return hydraulic fluid into the vessel 4. The pressure of fluid in a conduit 10A, which receives fluid from the outlet port T, matches atmospheric pressure and/or the pressure of fluid in the vessel 4. During certain stages of operation, the relay valve 9 can seal the accumulators and the source 3 from the valve 10. This can entail savings in energy. The valve 9 is controlled by the circuit 24.

The driving arrangement of FIG. 1 further comprises a suction receptacle 19 which can be said to form part of the sump and can respectively admit hydraulic fluid to the working chambers 11, 12 via one-way ball check valves 17, 18. A one-way ball check valve 15 can admit fluid from the working chamber 11 into a selected accumulator 8, 8', 8'' or 8''', and a similar one-way ball check valve 16 can admit fluid from the working chamber 12 into one of the just-enumerated accumulators. The conduits CON which contain the check valves 15 to 18 are preferably as short as possible and have relatively large inner diameters so that they offer negligible resistance to the flow of fluid therethrough. The suction receptacle 19 can be omitted if the vessel 4 is placed sufficiently close to the motor 13 so that such vessel can replace the receptacle 19.

The mounting of the check valves 15 and 16 is such that, when the pressure in the respective working chamber 11 or 12 rises to a preselected value, the valve 15 or 16 opens and allows pressurized fluid to leave the respective chamber 11 or 12 in order to flow into one of the accumulators 8, 8', 8'', 8'''. These check valves prevent the fluid from flowing in the opposite direction, i.e., from one of the accumulators 8 to 8''' into the working chamber 11 or 12. When the pressure in the working chamber 11 or 12 drops below atmospheric pressure, the corresponding check valve 17 or 18 opens and allows such working chamber to receive fluid from the suction receptacle 19.

The velocity v and the extent of movement (travel) s of the mass 23 are determined by the electronic control circuit 24 via stepping motor 25 which actuates the regulating valve 10. The latter is mechanically coupled with the hydraulic motor 13 via connection 10B. The manner in which the hydraulic motor 13 cooperates with the regulating valve 10 is or can be similar or identical to that disclosed in full detail in German Offenlegungsschrift No. 29 10 530 corresponding to the allowed U.S. patent application Ser. No. 127,402, now U.S. Pat. No. 4,369,693. The disclosure of this patent is incorporated herein by reference, the same as the disclosure of U.S. Pat. No. 3,797,364 which discloses the matter of German Offenlegungsschriften Nos. 20 62 134 and 21 53 506. Another suitable regulating valve-control circuit combination which can be used in the arrangement of the present invention is disclosed in German Offenlegungsschrift No. 25 01 760.

The driving arrangement of FIG. 1 can be modified by replacing the check valves 15 and 16, or by connecting such check valves in parallel with, pairs of additional or auxiliary regulating valves 26, one pair for each of the accumulators 8, 8', 8'' and 8'''. The additional regulating valves 26 can further connect the respective accumulator 8, 8', 8'' or 8''' with the source 3 of pressurized fluid via conduit 27 and check valve 7. The additional valves 26 preferably constitute solenoid-operated valves and receive signals (to open or close the respective conduits) from the electronic control circuit 24 via suitable conductor means. Note the conductor means 24B, 24C for the additional regulating valves 26 which are associated with the accumulator 8. The conductor means between the remaining additional or auxiliary valves 26 and the control circuit 24 have been omitted for the sake of clarity.

The driving arrangement of FIG. 1 can be used in a wide variety of machines or apparatus for controlled acceleration and/or deceleration of one or more masses wherein the expenditures in energy for moving the mass or masses should be kept as low as possible. For example, the driving arrangement of the present invention can be incorporated in high-speed hydraulic presses, in means for moving rollers or drums, in looms and/or in many other systems wherein one or more masses must undergo rapid and accurately controlled acceleration and/or deceleration. The acceleration and/or deceleration need not be accurately controlled all the way between a condition of standstill and a condition of maximum speed or vice versa, i.e., it is equally possible to employ the improved driving arrangement in systems wherein controlled movements of one or more masses are required only during certain stages of acceleration and/or deceleration.

The mode of operation of the driving arrangement of FIG. 1 is as follows:

It is assumed that the mass 23 is at a standstill and that such mass is to be accelerated by admitting pressurized hydraulic fluid from one of the accumulators 8 to 8''' into the working chamber 11 of the hydraulic motor 13. The conduits which contain pressurized hydraulic fluid are indicated by phantom lines. It will be noted that the fluid flows from the accumulator 8, 8', 8'' or 8''' through the corresponding left-hand additional valve 26, conduit 27, relay valve 9, regulating valve 10, relay valve 9 and corresponding conduit CON into the working chamber 11 so that the piston 14 is moved in a clockwise direction, as viewed in FIG. 1, and expels hydraulic pressurized fluid from the working chamber 12 via relay valve 9, regulating valve 10 and conduit 10A into the vessel 4. The conduits wherein the pressure of hydraulic fluid is low are indicated by broken lines. The rate at which the pressurized fluid can flow into the working chamber 11 to accelerate the mass 23 via transmission 21A, 21, 22 (e.g., in a direction to the right, as viewed in FIG. 1) is determined by the control circuit 24 which actuates the regulating valve 10 via stepping motor 25. At such time, the conductor 24A transmits a signal to the circulating valve 6 which opens the conduit 6A so that the fluid which is supplied by the outlet of the pump 2 does not flow beyond the check valve 7 but is simply returned into the vessel 4. In other words, the source 3 does not supply any pressurized fluid into the conduit 27 and thence into the accumulators 8 to 8''' and/or directly into the chamber 11. If the pressure in the selected accumulator (8 in FIG. 1) does not suffice to accelerate the mass 23 at a rate which is selected by the control circuit 24, the latter transmits a signal via conductor 24A to close the circulating valve 6 so that the check valve 7 opens and admits pressurized hydraulic fluid from the source 3 into the conduit 27. If the source 3 is relatively small, or if such a source is to be made as small as possible, the pump 2 can admit pressurized fluid into the conduit 27 during the entire acceleration stage of the mass 23.

The accumulators 8 to 8''' are connected in parallel. The left-hand additional or auxiliary regulating valves 26 open in response to signals from the control circuit 24 when the respective accumulators are to supply pressurized fluid to the working chamber 11 or 12, and the right-hand additional valves 26 open in response to signals from the control circuit 24 when the respective accumulators are to receive fluid from the working chamber 11 or 12 (via valve 15 or 16).

In order to reduce the energy losses to a minimum, only one of the left-hand or right-hand valves 26 is open at any time. The arrangement is such that, when the mass 23 is to be accelerated at a rate which is determined by the control circuit 24, the latter opens the left-hand additional valve 26 for that accumulator (8, 8', 8'' or 8''') wherein the pressure of fluid is slightly above the desired pressure in the working chamber 11 or 12 (namely, in that chamber which is to receive pressurized fluid in order to accelerate the mass 23 in the desired direction). During deceleration of the mass 23, the control circuit 24 opens one of the right-hand additional valves 26, namely, that additional valve which is associated with the accumulator (8, 8', 8'' or 8''') wherein the pressure of confined fluid corresponds to or is slightly below the desired or optimum delaying or decelerating pressure in the working chamber 11 or 12 to thus achieve the desired rate of deceleration with optimal recovery of energy.

The number of accumulators can be increased above or reduced below four, depending on the desired range of acceleration and deceleration of the mass 23, and the same holds true for the pressure differentials between the accumulators. The pressure of fluid in each of the accumulators 8 to 8''' is different. Still further, the capacity of the accumulator 8 can deviate from that of the accumulators 8' to 8''', and the same can apply for the other three accumulators. It is presently preferred to select the capacities of the accumulators 8 to 8''' in such a way that the capacity of that accumulator (or those accumulators) wherein the pressure of confined hydraulic fluid comes nearest to the most frequently required working pressure is (are) greater than the capacity of the remaining accumulator or accumulators.

In order to ensure that the mass 23 is accelerated as rapidly as possible, the accumulators 8 to 8''' can be recharged during the intervals of idleness of the hydraulic motor 13. This is initiated by the control circuit 24 which can open the left-hand additional valves 26 when the relay valve 9 seals the conduit 27 so that hydraulic fluid is prevented from flowing from the valve 9 to the valve 10 (and thence to the motor 13 via valve 9) either from the source 2 or from the accumulator 8, 8', 8'' or 8'''. Such "recharging" of the accumulators 8 to 8''' via valve 7 is needed only if the recharging via right-hand additional valves 26 does not suffice while the shaft 20 and its piston 14 are being decelerated (to effect a controlled deceleration of the mass 23) and the piston 14 expels fluid from the working chamber 11 or 12 into one or more accumulators.

The pressure of fluid in that accumulator which supplies fluid to the working chamber 11 or 12 during acceleration of the mass 23 must appreciably exceed the desired maximum pressure in the working chamber 11 or 12 if the mass 23 is to be accelerated as quickly as possible. The difference between the pressure in the selected accumulator and the desired pressure in the working chamber 11 or 12 is less pronounced if the acceleration of the mass 23 is to take place at a lower rate of speed. Analogously, the differential between the pressure in the selected accumulator which receives fluid from the working chamber 11 or 12 during deceleration of the mass and the pressure of fluid in the working chamber which supplies liquid to such accumulator (by way of the valve 15 or 16 and the corresponding right-hand additional valve 26) is less pronounced if the deceleration of the mass 23 is slow, but the differential is much more pronounced if the mass is to be decelerated within a short or very short interval of time. In other words, the difference between the pressure in a selected accumulator and that working chamber which happens to communicate with the selected accumulator is a function of the rate at which the mass 23 is to be accelerated or decelerated, i.e., a function of the rate at which a chamber of the motor 13 receives pressurized fluid from the selected accumulator or discharges fluid into the selected accumulator.

The relay valve 9 may constitute, or it may be used in addition to, a changeover or switchover valve which can directly connect a selected accumulator (8, 8', 8'' or 8''') and/or the source 3 with the working chamber 11 or 12, i.e., without causing the fluid to flow through the regulating valve 10. Alternatively, the relay valve 9 (or the just mentioned discrete changeover or switchover valve) can be used to connect a selected accumulator and/or the source 3 directly with the working chamber 11 or 12 during one or more stages of operation of the motor 13 to accelerate or decelerate the mass 23 whereas the remaining stage or stages of each cycle is or are controlled (by causing the fluid to flow through the regulating valve 10) in a manner as described above. This relay valve 9 (or the afore-mentioned changeover or switchover valve) can assume a condition in which the electronic control circuit 24 ensures that the source 3 can admit pressurized fluid directly to one or more accumulators for the purposes which were outlined above, i.e., to ensure that the accumulators are recharged during the intervals of idleness of the motor 13.

Direct connection between a selected accumulator 8, 8', 8'' or 8''' and the working chamber 11 or 12, or between the outlet of the pump 2 and the working chamber 11 or 12, is desirable when it is necessary and/or advantageous to establish a very short path for the flow of pressurized fluid from a selected accumulator or from the pump 2 into the working chamber 11 or 12, i.e., when such fluid should not flow from the accumulator or pump to the relay valve 9, from the relay valve 9 to the regulating valve 10, from the regulating valve 10 back to the relay valve 9, and from the relay valve 9 into the working chamber 11 or 12. In such modified driving arrangement, the relay valve 9 and/or the aforementioned discrete switchover or changeover valve can be of the adjustable type so that it can regulate the rate of flow of fluid from the selected accumulator or from the pump 2 directly into the working chamber 11 or 12. FIG. 1 shows, by way of example, a changeover or switchover valve 109 which is installed in a conduit 109A connecting the accumulator 8 with the working chamber 12 and which is controlled by the circuit 24 via conductor means 109B. A second switchover valve can be provided to connect the accumulator 8 with the working chamber 11, and several additional switchover valves can be provided to connect the accumulators 8' to 8''' with the working chambers 11, 12 as well as to connect such chambers with the outlet of the pump 2.

In lieu of actuating the additional valves 26 in response to signals from the control circuit 24, it is possible to employ for such actuation mechanical control means, e.g., lobes or otherwise configurated protuberances on the toothed rack 22 and/or gear 21 of the transmission between the mass 23 and the output shaft 20 of the motor 13. One such cam is shown schematically on the rack 22, as at 122. This cam can be used to actuate the right-hand valve 26 for the accumulator 8 instead of the conductor means 24B, 24C. Similar mechanical control means can be provided for the other additional valves 26. Such mechanical control means can be used with advantage when the mode of operation is always the same, i.e., when there is no need for pronounced versatility which is afforded by the provision of the control circuit 24 and operative connections between such control circuit and the additional regulating valves 26. Moreover, the mechanical control means can be used in lieu of electronic control means when the extent of movement and/or the speed of movement (either acceleration or deceleration) of the mass 23 need not be controlled with utmost (or with a high or very high degree of) accuracy.

It has been found that the improved driving arrangement can save surprisingly large amounts of energy if the hydraulic motor 13 is a rotary piston motor. However, highly satisfactory savings in energy can also be achieved if the rotary piston motor 13 is replaced with another hydraulically operated motor, such as the double-acting cylinder and piston unit 13' of FIG. 2. This motor comprises a piston 14' which is reciprocable in the cylinder 13B' and is flanked by two working chambers 11', 12' corresponding to the chambers 11 and 12 of the motor 13 shown in FIG. 1. The piston rod 20' replaces the output shaft 20 and is directly connected with the mass 23 and piston 14'; furthermore, the piston rod 20' can be mechanically coupled to the main or primary regulating valve 10.

Figure 2:
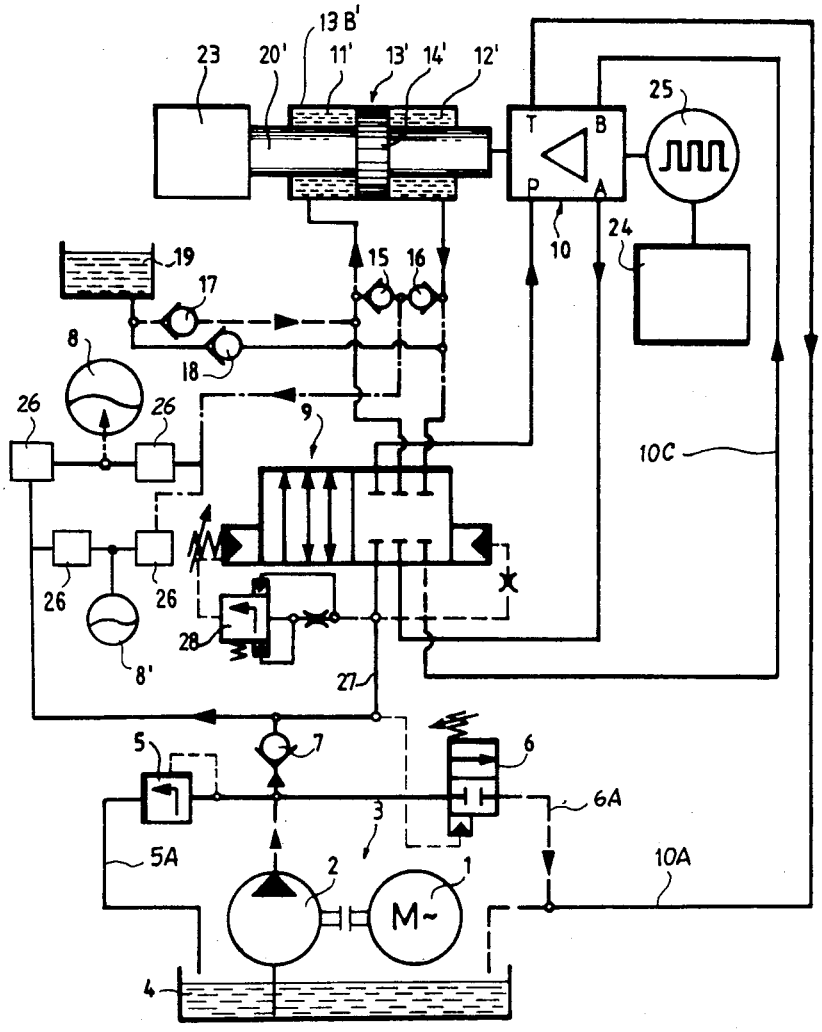
FIG. 2 is a similar schematic representation of a modified driving arrangement wherein the mass is reciprocable by a double-acting hydraulic cylinder and piston unit, the mass being in the process of deceleration.

All such parts of the driving arrangement of FIG. 2 which are identical with or clearly analogous to corresponding parts of the driving arrangement of FIG. 1 are denoted by similar reference characters. FIG. 2 merely shows one accumulator 8 and the corresponding additional or auxiliary regulating valves 26; however, it will be appreciated that this driving arrangement also comprises two or more accumulators which are connected in parallel, wherein the pressure of confined fluid is different, and each of which is associated with a pair of additional or auxiliary regulating valves in a manner and for the purposes as disclosed in connection with the embodiment of FIG. 1.

FIG. 2 illustrates the modified driving arrangement during that stage of operation when the motor 13' is in the process of hydraulically decelerating or braking the mass 23. The relay valve 9 is controlled by a pilot valve 28 in such a way that it seals the conduit 27 from the main regulating valve 10 (which is controlled by the electronic circuit 24), i.e., the regulating valve 10 is sealed from the accumulators and from the source 3. The mass 23 is assumed to require controlled deceleration during movement in a direction to the right, as viewed in FIG. 2, i.e., the piston 14' is in the process of expelling hydraulic fluid from the right-hand working chamber 12' while the working chamber 11' draws hydraulic fluid from the suction receptacle 19 via ball check valve 17. The fluid which is expelled from the working chamber 12' by the piston 14' flows into the accumulator 8 via right-hand additional regulating valve 26 of FIG. 2. Again, the paths for pressurized fluid are indicated by phantom lines, and the paths for the fluid at normal pressure are indicated by broken lines.

Figure 3:
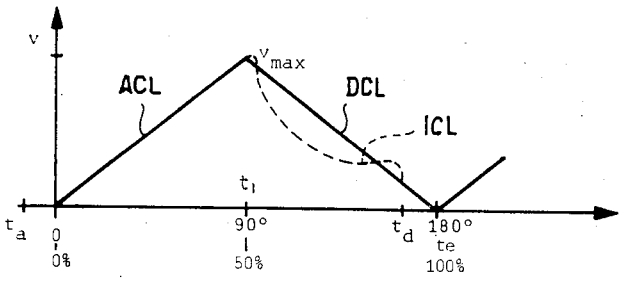
FIG. 3 is a velocity-time diagram showing the manner in which the mass can be accelerated or decelerated by the driving arrangement of FIG. 1 or 2.

The last stage of movement of the mass 23 to its right-hand end position can be controlled again by the circuit 24 via main regulating valve 10, e.g., during the interval between the instants $t_d$ and $t_e$ in the velocity-time diagram of FIG. 3. At such time, the pilot valve 28 causes the relay valve 9 to allow the flow of fluid through the main regulating valve 10 and thence into the vessel 4 via conduit 10A, i.e., the fluid leaves the chamber 12' via relay valve 9, flows into the regulating valve 10 via conduit 10C, and thereupon flows into the vessel 4 via conduit 10A. The control circuit 24 can determine the rate of acceleration of the mass 23 from zero speed to maximum speed and/or the rate of deceleration of the mass from maximum speed to zero speed, depending on the setting of the pilot valve 28. The conduit 27 receives pressurized fluid from the outlet of the pump 2 when the control circuit 24 closes the circulating valve 6 to prevent circulation of fluid along the path which is defined by the pump 2, conduit 6A and vessel 4.

The diagram of FIG. 3 shows one mode of moving the mass 23. The latter is to be gradually accelerated from zero speed to the maximum speed ($v_{max}$) and thereupon immediately decelerated back to zero speed, again gradually as respectively denoted by the curves ACL and DCL. The arrangement may be such that the rotary piston 14 of the motor 13 shown in FIG. 1 completes an angular movement through 90° during acceleration of the mass 23 from zero speed to $v_{max}$, and that the rotary piston 14 completes a further angular movement through 90° (i.e., a combined angular movement through 180°) for deceleration of the mass 23 back to zero speed. The acceleration takes place during the interval between $t_0$ and $t_1$, and the deceleration takes place during the interval between $t_1$ and $t_e$.

If the hydraulic motor is of the type shown in FIG. 2, the mass 23 is accelerated while the piston 14' performs 50% of its rightward or leftward stroke, and the mass 23 is thereupon decelerated while the piston 14' completes the other 50% of its rightward or leftward stroke.

The reference character $t_a$ denotes in FIG. 3 that instant when the charging of accumulators by the source 3 is completed, i.e., when the relief valve 5 opens to permit return flow of fluid from the outlet of the pump 2, via conduit 5A and into the vessel 4. If the interval between $t_a$ and $t_o$ is relatively long, the control circuit 24 can be programmed to open the circulating valve 6 so that the fluid can be circulated at a low pressure (e.g., atmospheric pressure) along the path which is defined by the pump 2, conduit 6A and vessel 4.

Figure 4:
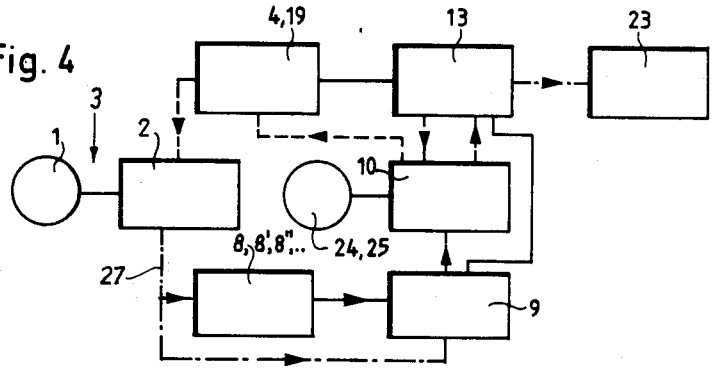
FIG. 4 is a block diagram showing the flow of fluid during acceleration of the mass by the driving arrangement of FIG. 1.

At the instant $t_o$, the control circuit 24 causes the regulating valve 10 to start with admission of fluid into the working chamber 11 or 12 so as to initiate gradual acceleration of the mass 23 in a manner as represented by the curve ACL. The valve 10 then admits into one of the working chambers 11, 12 pressurized fluid from that accumulator wherein the pressure of fluid is at least slightly higher than the desired pressure in the working chamber that is in the process of being filled. At the same time, the piston 14 causes the other working chamber to discharge the fluid, practically at no pressure, back into the vessel 4 via conduit 10A. This is illustrated schematically in FIG. 4.

Figure 5:
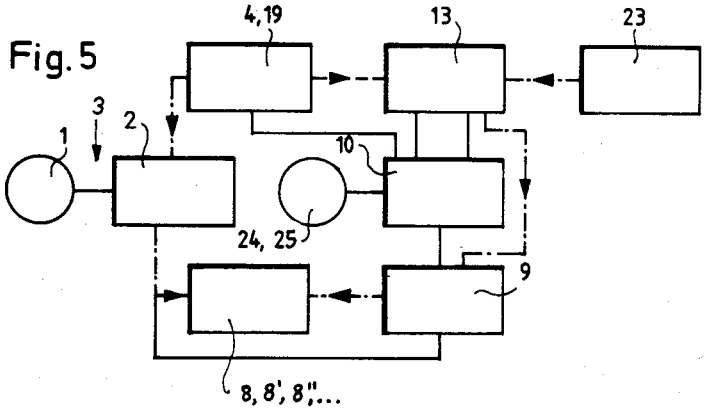
FIG. 5 is a similar block diagram showing the flow of fluid during deceleration of the mass by the driving arrangement of FIG. 1.

When the speed of the mass 23 reaches the value $v_{max}$, the control circuit 24 transmits a signal via conductor means 24D to change the condition of the relay valve 9 so that the speed of the mass 23 begins to decrease gradually as indicated by the curve DCL. The flow of fluid during this stage of a cycle is represented in FIG. 5. The fluid in the chamber 11 or 12 offers a resistance to continuous forward movement of the piston 14 in a direction to move the mass 23 so that the piston and the mass are braked at a controlled rate and the mass comes to a full stop at the instant $t_e$. The fluid which is being expelled from the working chamber 11 or 12 flows through the one-way ball check valve 15 or 16 and into the selected accumulator so that the pressure in the selected accumulator rises in response to or during deceleration of the mass. In other words, the accumulator which can be empty or practically empty when the speed of the mass 23 reaches the value $v_{max}$ is recharged during deceleration of the mass back to zero speed.

As already mentioned hereinbefore, deceleration of the mass 23 back to zero speed can take place at an uncontrolled rate, for example, during a certain portion of the decelerating stage of a cycle. This is indicated in FIG. 3 by a broken-line curve ICL; such irregular deceleration can take place during the interval between $t_1$ and $t_d$, whereupon the control circuit 24 takes over to effect controlled deceleration of the mass 23 during the interval between $t_d$ and $t_e$, i.e., during the last stage of a complete cycle. The control circuit 24 transmits a signal via conductor means 24D at the instant $t_d$ so that the relay valve 9 again transmits fluid to the main regulating valve 10 which is controlled by the circuit 24 via stepping motor 25 to effect predictable and reproducible deceleration of the mass 23 during the interval between $t_d$ and $t_e$. At the same time, the control circuit 24 transmits a signal via conductor 24A so that the circulating valve 6 closes and the source 3 can complete the recharging of the selected accumulator which is in communication with the motor 13 or 13' during the selected cycle. Such recharging of the selected accumulator directly from the source 3 ensures that the accumulator stores a sufficient amount of energy for the next operation. The same cycle can be repeated again and again, whereby the source 3 merely serves to replenish that amount of energy which is lost between acceleration and deceleration. Moreover, the source 3 compensates for leakage of hydraulic fluid (e.g., oil) from the hydraulic circuit, for losses due to friction and/or other losses attributable to the flow of fluid.

The improved driving arrangement renders it possible to recover and hydraulically store a substantial percentage of kinetic energy of the moving mass 23 as well as to reuse the thus stored energy for acceleration of the mass.

An important advantage of the improved driving arrangement is that its energy requirements are considerably lower than those of heretofore known driving arrangements. This is attributed to the provision of a battery of accumulators each of which can store hydraulic fluid at a different pressure and each of which is individually connectable with the hydraulic motor so as to supply pressurized fluid when the required pressure of such fluid is slightly below the pressure of fluid in the selected accumulator or to receive fluid from the motor when the desired pressure in the working chamber which discharges fluid is equal to or slightly above the pressure of fluid in the selected accumulator. The working chamber whose volume is on the increase during deceleration of the mass 23 receives fluid directly from the suction reservoir 19 or from the vessel 4. One of the check valves 15, 16 opens when the speed of the mass 23 is on the decrease so that the valve 15 or 16 can admit fluid into a selected accumulator, and one of the check valves 17, 18 opens when one of the working chambers is being evacuated by the piston 14 or 14' during deceleration of the mass 23 so that the other chamber can draw fluid directly from the suction reservoir 19 or vessel 4.

It has been found that the provision of several accumulators, each of which stores hydraulic fluid at a different pressure, ensures the recovery of surprisingly large amounts of energy during deceleration of the mass 23. Losses in pressure of hydraulic fluid are held to a minimum due to direct connection of the working chamber 11 or 12 with the suction reservoir 19 or vessel 4 via check valve 17 or 18 at the time when the volume of the respective working chamber is on the increase due to expulsion of fluid from the other working chamber by the piston 14 or 14' (while the speed of the mass 23 is on the decrease). Moreover, such direct connection of the working chamber 11 or 12 with the suction receptacle 19 or vessel 4 reduces the likelihood of cavitation in the working chambers of the hydraulic motor 13 or 13'.

The relay valve 9 also contributes to highly satisfactory recovery of energy during refilling of a selected accumulator with fluid which is being expelled from the one or the other working chamber during deceleration of the mass 23. This relay valve controls the effective cross-sectional areas of the passages for the flow of fluid from the hydraulic motor 13 or 13' to the selected accumulator. Appropriate signals for such regulation of the cross-sectional areas of the passages for the flow of fluid are furnished by the control circuit 24, i.e., the control circuit ensures that the acceleration or deceleration of the mass 23, as well as the distance which is covered by the mass during acceleration or deceleration, is best suited to ensure recovery of a high percentage of energy when the selected accumulator receives fluid from the one or the other working chamber of the motor.

The provision of suction receptacle 19 and/or direct connectability of the vessel 4 with the one or the other working chamber of the hydraulic motor, while the volume of such working chamber is on the increase during deceleration of the mass 23, ensures that the pressure in the working chamber which draws fluid from the receptacle 19 or vessel 4 does not drop well below atmospheric pressure because this could result in a pronounced resistance to movement of the piston 14 or 14' in a direction to expel liquid into the selected accumulator during the deceleration stage. Direct refilling of the working chamber 11 or 12, or working chamber 11' or 12', with the fluid which is drawn from the suction receptacle 19 or directly from the vessel 4 eliminates the need for the flow of such fluid along a circuitous path which is defined by the relay valve 9 and wherein the flow of fluid is necessarily throttled, at least to a certain degree, well in excess of the throttling action upon the fluid which flows from the suction receptacle 19 or vessel 4 directly into the working chamber 11, 11', 12 or 12'. The check valves 17 and 18 constitute a very simple but highly effective and reliable control unit for regulation of the direct flow of fluid from the suction receptacle 19 or vessel 4 directly into one of the working chambers, i.e., the provision of such simple check valves eliminates the need for more complex, more expensive and more sensitive control means.

When the pressure in one of the working chambers is excessive, fluid can automatically escape from such working chamber via check valve 15 or 16 and into that accumulator whose right-hand regulating valve 26 is then open. As mentioned above, the paths which are defined by the conduits CON are preferably selected in such a way that these conduits offer a minimal resistance to the flow of fluid, either from a working chamber into a selected accumulator or from the suction reservoir 19 into one of the working chambers. This also reduces the losses in energy and allows for more predictable operation of the driving arrangement.

Each of the check valves 15, 16 can be replaced by an entire set of valves, one for each of the accumulators. The operation of the check valves in each set is then selected in such a way that only one thereof opens when a certain pressure prevails in the respective working chamber. This results in even higher savings of energy because only the right accumulator is allowed to communicate with the working chamber which is to discharge fluid into one of the accumulators. The provision of such sets of check valves 15, 16 would obviate the need for the right-hand additional regulating valves 26 each of which opens or closes in response to a signal from the control circuit 24. The left-hand valves 26 of FIG. 1 also regulate the flow of fluid in response to signals from the control circuit 24; such signals are transmitted by the circuit 24 to ensure that the working chamber 11, 12, 11' or 12' receives fluid from that accumulator wherein the pressure of fluid is at least slightly higher than the desired pressure of fluid in the working chamber which is in the process of receiving pressurized fluid, as contrasted with the admission of non-pressurized fluid from the suction receptacle 19 or directly from the vessel 4.

The recovery of energy is further promoted, during certain stages of operation of the driving arrangement, by fully opening the relay valve 9 at a time when a selected accumulator receives or discharges hydraulic fluid. The relay valve 9 then offers minimal resistance to the flow of fluid therethrough.

As mentioned above, the dimensions and cost of the source 3 can be reduced considerably if the accumulators can be charged directly from such source, e.g., during the intervals of idleness of the motor 13 or 13'. This ensures that a selected accumulator can even supply fluid at the time when the energy requirements of the motor 13 or 13' are at a peak value, i.e., there is no need to ensure that such peak energy requirements can be met by the source 3 for short intervals of time and synchronously with operation of the motor.

The provision of the circulating valve 6 also results in a reduction of energy requirements because this valve can be opened by the control circuit 24 whenever the operation is interrupted for a short interval of time which, in a conventional driving arrangement, would necessitate a pronounced throttling of the flow of pressurized fluid with attendant energy losses. If desired, the valve 6 can be actuated in dependency on the pressure of fluid in the conduit 27 or in the accumulators, especially if the accumulators (or that accumulator which is to control the valve 6) can store large quantities of hydraulic fluid. Under certain circumstances, the maximum pressure of fluid in the accumulators can be adjusted by the control circuit 24 so as to conform to energy requirements of the hydraulic motor.

The provision of the aforediscussed switchover valves 109 (of which only one is actually shown in FIG. 1) also contributes to a reduction of energy requirements of the improved driving arrangement. As explained above, such switchover valves can directly connect the selected accumulator or the source 3 with one of the working chambers. For example, the working chamber 11 or 12 of FIG. 1 can be directly connected with the outlet of the pump 2 when the motor 13 is to receive hydraulic fluid at the maximum available pressure with a minimum of delay and without any throttling as a result of flow through the valve 9 and/or 10.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An arrangement for effecting a controlled acceleration and/or deceleration of masses comprising:

(a) a hydraulic motor having an output element which is designed to be accelerated and decelerated and is arranged to transmit motion to a mass, said motor being provided with a pair of variable-volume working chambers;

(b) a plurality of accumulators each arranged to confine a supply of hydraulic fluid at a different pressure;

(c) means for sealing said accumulators from and connecting said accumulators with said chambers, said sealing and connecting means including first conduit means for delivering hydraulic fluid from said accumulators to said chambers so as to accelerate said output elements, and second conduit means for delivering hydraulic fluid from said chambers to said accumulators upon deceleration of said output element, and said sealing and connecting means further including a main regulating valve and a relay valve in said first conduit means, a coupling between said main regulating valve and said motor, and additional valves in said first and second conduit means including a pair of solenoid valves for each of said accumulators;

(d) a source of pressurized hydraulic fluid connected with said first conduit means;

(e) a circulating valve provided in said first conduit means between said source and said accumulators and operable to reduce the pressure of fluid in said source as a function of fluid pressure changes in at least one of said accumulators and/or as a function of fluid pressure changes in said first conduit means, said sealing and connecting means further including electronic control means for operating said main, relay, solenoid, and circulating valves and said control means being arranged to connect one of said chambers with a selected accumulator during deceleration of said output element;

(f) sump means including a receptacle for hydraulic fluid;

(g) third conduit means for discharging hydraulic fluid from a respective chamber into said sump means when the volume of the chamber is decreasing and the chamber is sealed from said accumulators; and (h) means arranged to couple a respective chamber with said receptacle when the volume of the chamber is increasing and the chamber is sealed from said accumulators so that the chamber can draw hydraulic fluid from said receptacle, said means to couple including fourth conduit means connecting said receptacle with said chambers, and pressure-responsive one-way valve means in said fourth conduit means arranged to open when the pressure in a respective chamber is less than that in said receptacle.

2. The arrangement of claim 1, wherein said control means is arranged to determine the rate of fluid flow between a working chamber and a selected accumulator as a function of the distance covered by said output element.

3. The arrangement of claim 1, wherein said control means is arranged to determine the rate of fluid flow between a selected accumulator and a working chamber as a function of time.

4. The arrangement of claim 1, further comprising chargeover valve means operable by said control means to connect said source directly with a working chamber.

5. The arrangement of claim 1, further comprising changeover valve means operable by said control means to connect a selected accumulator directly with a working chamber.

6. The arrangement of claim 1, wherein said motor includes a rotary piston motor.

7. The arrangement of claim 1, wherein said sealing and connecting means is arranged to connect said one chamber with a selected accumulator and to connect said other chamber with said sump means during acceleration of said output element, said output element being arranged to expel fluid from said other chamber during acceleration and deceleration and to draw fluid from said receptacle into said one chamber during deceleration.

8. The arrangment of claim 1, wherein said relay valve is operable by said control means to control the flow of fluid from said source to said main regulating valve.

9. The arrangement of claim 1, wherein a pressure-responsive, one-way valve is arranged to permit fluid flow from said source to said first conduit means.

* * * * *